US005851130A

United States Patent [19]

Wainwright

[11] Patent Number: 5,851,130

[45] Date of Patent: Dec. 22, 1998

[54] WATERCRAFT INTAKE DEBRIS CLEANER

[76] Inventor: Ralph Wainwright, 1147 Jacksonville Rd., Bordentown, N.J. 08505

[21] Appl. No.: 992,138

[22] Filed: Dec. 17, 1997

[51] Int. Cl.[6] ..... B63H 11/01

[52] U.S. Cl. ..... 440/46

[58] Field of Search ..... 210/107, 413; 440/46, 38, 47

[56] References Cited

U.S. PATENT DOCUMENTS 3,279,414 10/1966 Rabald ..... 440/46
5,324,216 6/1994 Toyohara et al. ..... 440/46
5,598,804 2/1997 Vostitsanos ..... 440/46

FOREIGN PATENT DOCUMENTS 5229481 9/1993 Japan ..... 440/46

*Primary Examiner*—Stephen Avila

[57] ABSTRACT

A watercraft intake debris cleaner is provided including a watercraft having an outlet opening formed in a rear face thereof with a water propulsion mechanism mounted therein. An inlet opening is formed in a bottom face of the watercraft. A channel interconnects the inlet and the outlet for allowing fluidic communication therebetween. A cutting mechanism is mounted within the channel for cutting debris upon the actuation thereof.

3 Claims, 3 Drawing Sheets

WATERCRAFT INTAKE DEBRIS CLEANER

BACKGROUND OF THE INVENTION

1. Field of the Invention

The present invention relates to watercraft intake screens and more particularly pertains to a new watercraft intake debris cleaner for actively removing debris from an intake of a water propulsion unit of a watercraft.

2. Description of the Prior Art

The use of watercraft intake screens is known in the prior art. More specifically, watercraft intake screens heretofore devised and utilized are known to consist basically of familiar, expected and obvious structural configurations, notwithstanding the myriad of designs encompassed by the crowded prior art which have been developed for the fulfillment of countless objectives and requirements.

Known prior art watercraft intake screens include U.S. Pat. No. 5,234,361; U.S. Pat. No. 4,237,812; U.S. Pat. No. 5,224,887; U.S. Pat. No. 3,942,463; U.S. Pat. No. 4,718,871; and U.S. Pat. No. 4,938,724.

In these respects, the watercraft intake debris cleaner according to the present invention substantially departs from the conventional concepts and designs of the prior art, and in so doing provides an apparatus primarily developed for the purpose of actively removing debris from an intake of a water propulsion unit of a watercraft.

SUMMARY OF THE INVENTION

In view of the foregoing disadvantages inherent in the known types of watercraft intake screens now present in the prior art, the present invention provides a new watercraft intake debris cleaner construction wherein the same can be utilized for actively removing debris from an intake of a water propulsion unit of a watercraft.

The general purpose of the present invention, which will be described subsequently in greater detail, is to provide a new watercraft intake debris cleaner apparatus and method which has many of the advantages of the watercraft intake screens mentioned heretofore and many novel features that result in a new watercraft intake debris cleaner which is not anticipated, rendered obvious, suggested, or even implied by any of the prior art watercraft intake screens, either alone or in any combination thereof.

To attain this, the present invention generally comprises a watercraft having a vertically oriented outlet opening formed in a rear face thereof. As shown in FIG. 1, a water propulsion mechanism is mounted within the outlet opening. Associated therewith is a horizontally oriented inlet opening with a rectangular configuration formed in a bottom face of the watercraft. A channel interconnects the inlet and the outlet for allowing fluidic communication therebetween. Next provided is a stationary plate mounted in the inlet of the watercraft in coplanar relationship with the bottom face of the watercraft. The stationary plate has a matrix of a square cut outs formed therein. Further, a pair of inverted L-shaped guides are coupled along side edges of the stationary plate. Such guides extend upwardly from the stationary plate into the channel of the watercraft. In their operative orientation, the guides reside in parallel relationship with a longitudinal axis of the watercraft. FIGS. 6 & 7 show a reciprocating plate having a shape and size similar to that of the stationary plate. A matrix of square cut outs is formed in the present plate. The reciprocating plate is slidably situated between the guides of the stationary plate in abutment and coplanar relationship with the reciprocating plate. The reciprocating plate further has a tab mounted on a top frontal edge thereof with an aperture formed therein along an axis perpendicular to the longitudinal axis of the watercraft. Finally, a drive assembly is provided including a drive arm having a first end pivotally coupled to the aperture of the tab of the reciprocating plate. The drive arm extends through an enlarged opening formed in the channel of the watercraft. As such, a second end of the drive arm extends within an interior space of the watercraft. An elastomeric bushing is formed within the enlarged opening and encompasses the drive arm for precluding water from entering the watercraft. The drive assembly further includes a motor having a radial member mounted to a rotor thereof, as shown in FIG. 4. Such radial member is further pivotally connected to the second end of the drive arm for moving the reciprocating plate frontward and backward in a reciprocating manner upon the actuation of the motor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new watercraft intake debris cleaner apparatus and method which has many of the advantages of the watercraft intake screens mentioned heretofore and many novel features that result in a new watercraft intake debris cleaner which is not anticipated, rendered obvious, suggested, or even implied by any of the prior art watercraft intake screens, either alone or in any combination thereof.

It is another object of the present invention to provide a new watercraft intake debris cleaner which may be easily and efficiently manufactured and marketed.

It is a further object of the present invention to provide a new watercraft intake debris cleaner which is of a durable and reliable construction.

An even further object of the present invention is to provide a new watercraft intake debris cleaner which is susceptible of a low cost of manufacture with regard to both materials and labor, and which accordingly is then susceptible of low prices of sale to the consuming public, thereby making such watercraft intake debris cleaner economically available to the buying public.

Still yet another object of the present invention is to provide a new watercraft intake debris cleaner which provides in the apparatuses and methods of the prior art some of the advantages thereof, while simultaneously overcoming some of the disadvantages normally associated therewith.

Still another object of the present invention is to provide a new watercraft intake debris cleaner for actively removing debris from an intake of a water propulsion unit of a watercraft.

Even still another object of the present invention is to provide a new watercraft intake debris cleaner that includes a watercraft having an outlet opening formed in a rear face thereof with a water propulsion mechanism mounted therein. An inlet opening is formed in a bottom face of the watercraft. A channel interconnects the inlet and the outlet for allowing fluidic communication therebetween. A cutting mechanism is mounted within the channel for cutting debris upon the actuation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
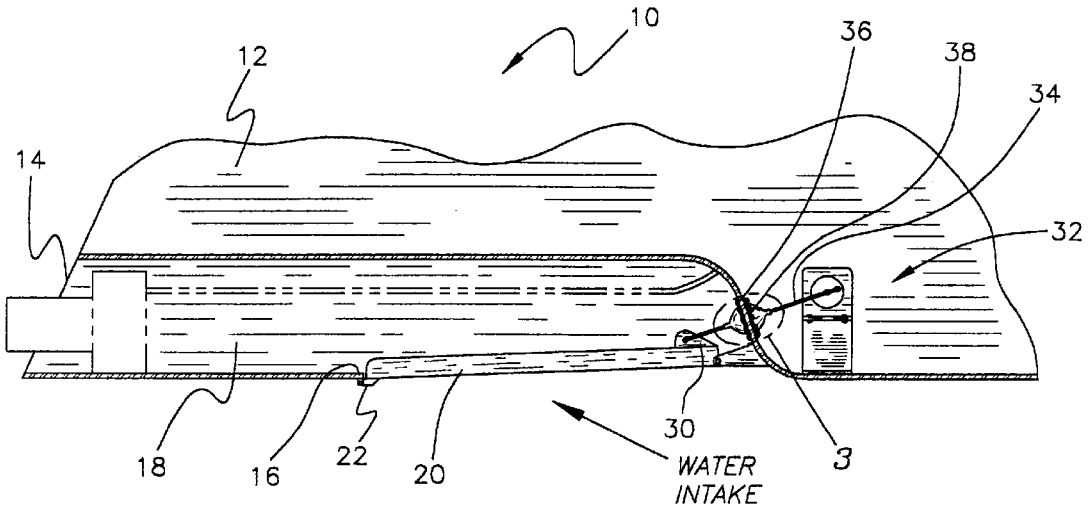
FIG. 1 is a side cross-sectional view of a new watercraft intake debris cleaner according to the present invention.
Figure 2:
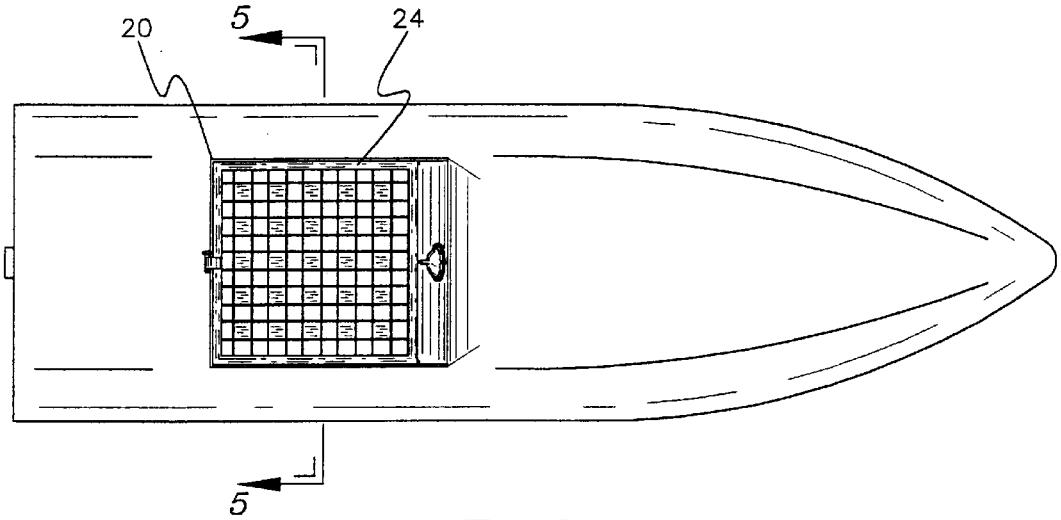
FIG. 2 is a top view of the present invention.
Figure 3:
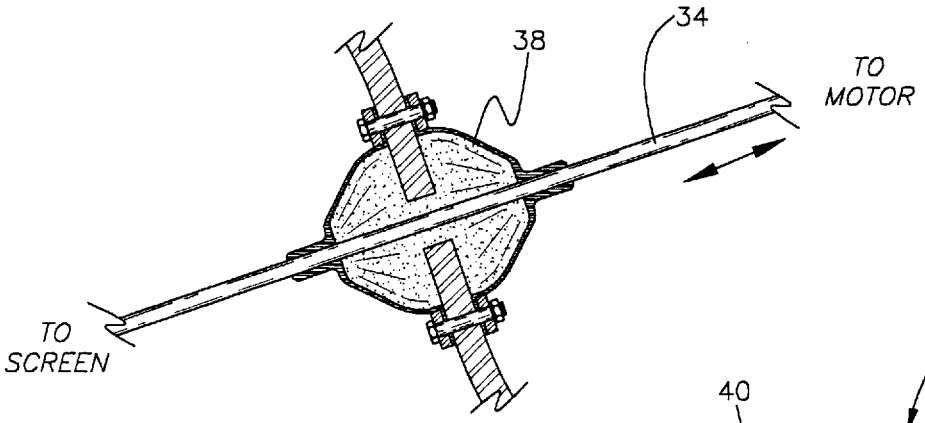
FIG. 3 is a cross-sectional view of the elastomeric bushing and drive arm of the present invention.

With reference now to the drawings, and in particular to FIGS. 1 through 7 thereof, a new watercraft intake debris cleaner embodying the principles and concepts of the present invention and generally designated by the reference numeral 10 will be described.

The present invention, designated as numeral 10, includes a watercraft 12 having a vertically oriented outlet opening 14 formed in a rear face thereof. As shown in FIG. 1, a water propulsion mechanism is mounted within the outlet opening. Associated therewith is a horizontally oriented inlet opening 16 with a rectangular configuration formed in a bottom face of the watercraft. A horizontal channel 18 interconnects the inlet and the outlet for allowing fluidic communication therebetween.

Next provided is a square stationary plate 20 mounted in the inlet of the watercraft in coplanar relationship with the bottom face of the watercraft. To accomplish this, a front extent of the stationary plate is pivotally coupled to the inlet and a rear extent is fixed with respect to the inlet by way of a pin and aperture combination 22. The stationary plate has a uniform matrix of a square cut outs 23 formed throughout an entire surface thereof. Further, a pair of inverted L-shaped guides 24 are coupled along side edges of the stationary plate. Such guides extend upwardly from the stationary plate into the channel of the watercraft. In their operative orientation, the guides reside in parallel relationship with a longitudinal axis of the watercraft.

Figure 5:
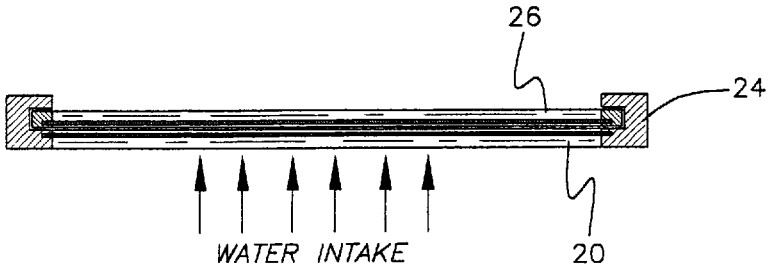
FIG. 5 is a front cross-sectional view of the plates of the present invention.
Figure 6:
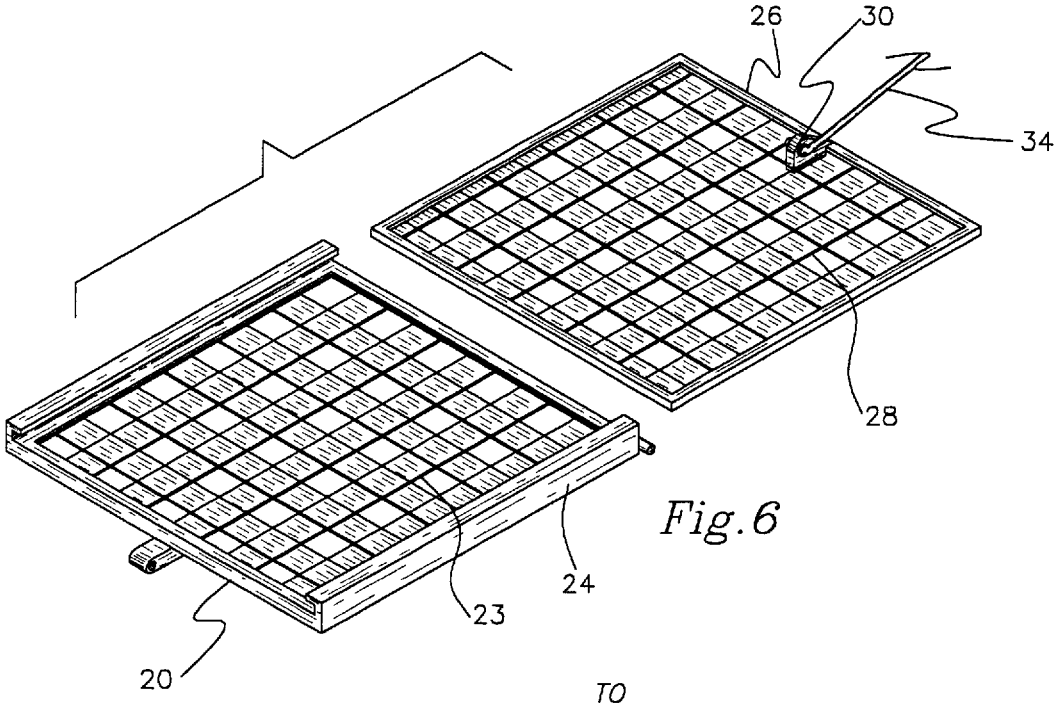
FIG. 6 is an exploded perspective view of the present invention.
Figure 7A:
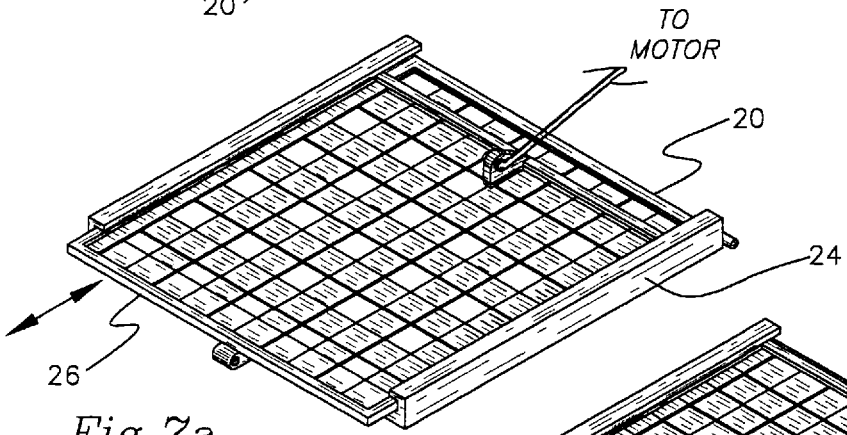
FIGS. 7A & 7B are perspective views of the various orientations of the reciprocating plate of the present invention.
Figure 7B:
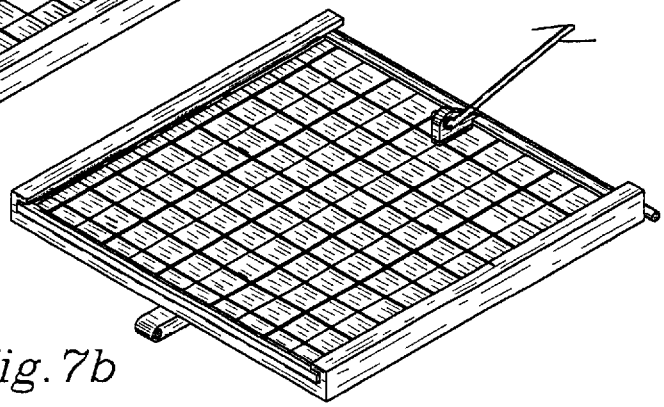

FIGS. 6 & 7 show a reciprocating plate 26 having a shape and size similar to that of the stationary plate. A matrix of square cut outs 28 is formed in the present plate. The reciprocating plate is slidably situated between the guides of the stationary plate in abutment and coplanar relationship with the reciprocating plate. Preferably, sides of the reciprocating plate have elongated rigid strips coupled thereto with a square cross-section, as shown in FIG. 5, for being fittedly situated within slots defined by the guides. The reciprocating plate further has a tab 30 mounted on a top frontal edge thereof with an aperture formed therein along an axis perpendicular to the longitudinal axis of the watercraft.

Depending on the specific application, either aluminum or stainless steel may be used to construct the plates. Further, it is preferred that edges of the cut outs of the reciprocating plate be sharpened.

Finally, a drive assembly 32 is provided including a drive arm 34 having a first end pivotally coupled to the aperture of the tab of the reciprocating plate. The drive arm extends through an enlarged opening 36 formed in the channel of the watercraft. As such, a second end of the drive arm extends within an interior space of the watercraft. An elastomeric bushing 38 is formed within the enlarged opening and encompasses the drive arm for precluding water from entering the watercraft. The elastomeric bushing preferably consists of a hollow member with a pair of opposed apertures for passing the drive arm. An interior of the bushing is ideally filled with a highly viscous sealing agent.

Figure 4:
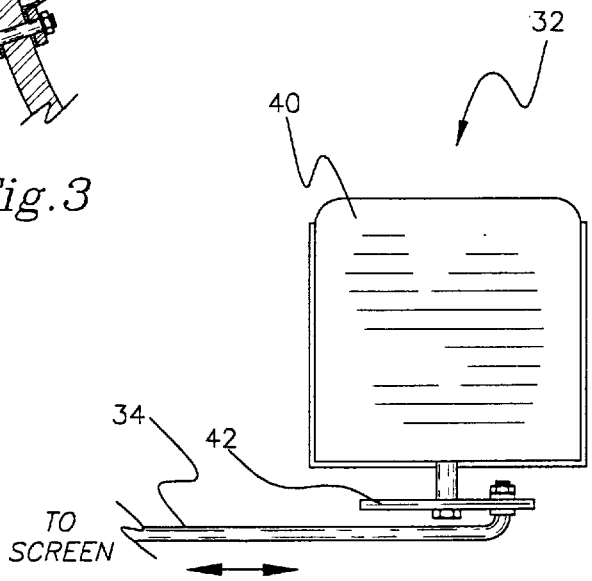
FIG. 4 is a top view of the motor of the present invention.

The drive assembly further includes a motor 40 having a radial member 42 mounted to a rotor thereof, as shown in FIG. 4. Such radial member is further pivotally connected to the second end of the drive arm for moving the reciprocating plate frontward and backward in a reciprocating manner upon the actuation of the motor. Preferably, the motor is selectively actuated independent of watercraft operation. Further, electric control means, such as a limit switch or the like, is preferably afforded for ensuring that the cut outs of the plates are aligned when the motor is deactuated. During use, when the motor is actuated, the cut outs of the plates are moved between an aligned orientation and a misaligned orientation thereby cutting any debris such as seaweed or the like and passing the same through the water propulsion unit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A watercraft intake debris cleaner comprising, in combination:

a watercraft having a vertically oriented outlet opening formed in a rear face thereof with a water propulsion mechanism mounted therein, a horizontally oriented inlet opening with a rectangular configuration formed in a bottom face of the watercraft, and a channel interconnecting the inlet and the outlet for allowing fluidic communication therebetween;

a stationary plate mounted in the inlet of the watercraft in coplanar relationship with the bottom face thereof, the stationary plate having a matrix of a square cut outs formed therein and a pair of inverted L-shaped guides formed along side edges of the stationary plate and extended upwardly therefrom into the channel of the watercraft, wherein the guides reside in parallel relationship with a longitudinal axis of the watercraft;

a reciprocating plate having a shape and size similar to that of the stationary plate with a matrix of square cut outs formed therein, the reciprocating plate being slidably situated between the guides of the stationary plate in abutment with the reciprocating plate, the reciprocating plate having a tab mounted on a top frontal edge thereof with an aperture formed therein along an axis perpendicular to the longitudinal axis of the watercraft; and a drive assembly including a drive arm having a first end pivotally coupled to the aperture of the tab of the reciprocating plate and extending through an enlarged opening formed in the channel of the watercraft such that a second end thereof extends within an interior space of the watercraft with an elastomeric bushing formed within the enlarged opening about the drive arm, the drive assembly further including a motor having a radial member mounted to a rotor thereof and further pivotally connected to the second end of the drive arm for moving the reciprocating plate frontward and backward in a reciprocating manner upon the actuation thereof.

2. A watercraft intake debris cleaner comprising:

a watercraft having an outlet opening formed in a rear face thereof with a water propulsion mechanism mounted therein, an inlet opening formed in a bottom face of the watercraft, and a channel interconnecting the inlet and the outlet for allowing fluidic communication therebetween; and a cutting means mounted in communication with the channel for cutting debris upon the actuation thereof, the cutting means including a pair of planar plates each with a matrix of cut outs formed therein, the plates being in slidable abutment and adapted to move in a reciprocating manner when actuated.

3. A watercraft intake debris cleaner as set forth in claim 2 wherein the cutting means has associated therewith a motor residing within the watercraft for reciprocating the cutting means.

* * * * *